US006994578B1

(12) United States Patent
Chen

(10) Patent No.: US 6,994,578 B1
(45) Date of Patent: Feb. 7, 2006

(54) MICRO-CONNECTOR STRUCTURE AND FABRICATING METHOD THEREOF

(75) Inventor: Hsing Chen, Hsinchu (TW)

(73) Assignee: Solidlite Corporation, Hsinchu (TW)

( * ) Notice: Subject to any disclaimer, the term of this patent is extended or adjusted under 35 U.S.C. 154(b) by 0 days.

(21) Appl. No.: 10/928,872

(22) Filed: Aug. 28, 2004

(51) Int. Cl.
*H01R 25/00* (2006.01)

(52) U.S. Cl. ..... 439/291; 439/492; 439/284; 439/287; 439/931; 439/886

(58) Field of Classification Search ..... 439/284, 439/287, 290, 931, 886, 492
See application file for complete search history.

(56) References Cited

U.S. PATENT DOCUMENTS 5,071,363 A * 12/1991 Reylek et al. ..... 439/291

* cited by examiner

*Primary Examiner*—Tho D. Ta

(57) ABSTRACT

MICRO-CONNECTOR STRUCTURE AND method of making the same are disclosed. The micro-connector is microminiaturized and improved its degree of compaction by using semiconductor process. The process is etching silicon substrates into V-shaped channels and then a layer of nanometer structure is grown on them to increase stability of conductivity.

6 Claims, 7 Drawing Sheets

MICRO-CONNECTOR STRUCTURE AND FABRICATING METHOD THEREOF

FIELD OF THE INVENTION

The present invention relates to MICRO-CONNECTOR STRUCTURE AND fabricating method thereof, more particular, to a micro-connector made of two silicon substrates and multiple micro-channels constructed thereon. Then multiple nano-meter lines are grown on the micro-channels by nano-technology to improve the ability of electronic signal transmission and of absorbing external shocks.

BACKGROUND OF THE INVENTION

Conventional connectors, such as RS232 etc., have multiple conductive pins. And the multiple pins are coated by a plastic insulation shell. These conventional connectors are connected with computers by matching male-female pins. They are disclosed in Taiwan patent publication no. 573835 and U.S. patent application Ser. No. 10/375,789.

The disadvantage of the conventional connector is that if the conductive pins in conventional connectors are too slender, they become more fragile. So it is impossible to microminiaturize the connector and to arrange too many conductive pins inside the connector. Therefore, new technique has to be developed to microminiaturize connector.

The inventor of the present invention has researched microminiaturized structures of the electronic device for many years, and has applied several patent applications such as Taiwan patent applications no. 091104649 and 090130881. In order to resolve the problems caused by the conventional connector structure as described above, MICRO-CONNECTOR STRUCTURE AND method of making the same are disclosed.

SUMMARY OF THE INVENTION

The present invention provides a micro-connector to be used in telecommunication field. Following the trend of future of light in weight, thin and small in sizes, the present invention could be used in small communication devices, such as cell phone and notebook computer.

The present invention also provides a high precision semiconductor material based connector. It can be used in high temperature environment (120° C.) since silicon substrate has high rate of heat dissipation.

The present invention utilizes a semiconductor process in producing a structure to transmit electrical signal. First, two silicon substrates are lithographed, then are etched using dry and wet etching. Multiple ridged lands are formed on one substrate; multiple V-shaped grooves are formed on the other substrate. After an insulation surface is formed on each two substrates by oxidation or nitriding, a conductive metal layer is plated on each surface of the ridged lands and the V-shaped grooves. On top of each conductive metal layer, a nano-meter structure layer can be formed to be used as electrical signal conduction and shock buffer. Multiple metal bands are plated at ends of those ridged lands and V-shaped grooves to connect with ribbon wires, respectively. When the two substrates are combined, a connector with the conductive V-shaped channel is completed.

The present invention of connector is much smaller than conventional connector in size and each V-shaped channel can reach micrometer order. Therefore the number of V-shaped channel will not be limited by physical size of connector. Conventionally, some electronic elements require higher stability because a little vibration can cause error in electrical signal transmission. However, at the present invention, because a nano-meter layer coated on the ridged lands and the V-shaped grooves, such as a nano-meter line which possesses characteristic of super elastic, shock absorbing and great conducting, the degree of compaction and conductivity between V-shaped channels are improved.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

Following drawings with reference numbers and exemplary embodiments are referenced for explanation purpose.

DETAILED DESCRIPTION OF THE PREFERRED EMBODIMENTS

Figure 1:
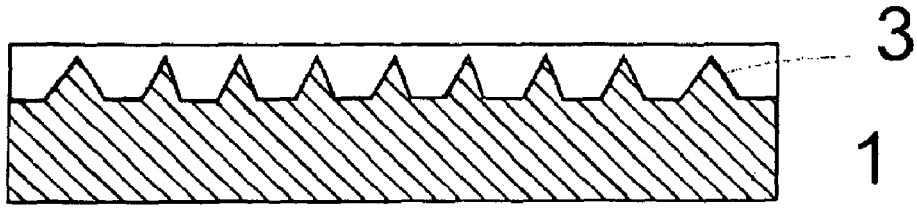
FIG. 1 is a cross sectional view of a first substrate.

Reference will now be made in detail to the preferred embodiments of the present invention, examples of which are illustrated in the accompanying drawings. Wherever possible, the same reference numbers are used in the drawings and the description to refer to the same or like parts.

Figure 2:
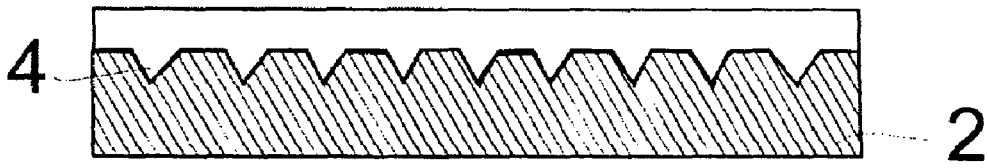
FIG. 2 is a cross sectional view of a second substrate.
Figure 3:
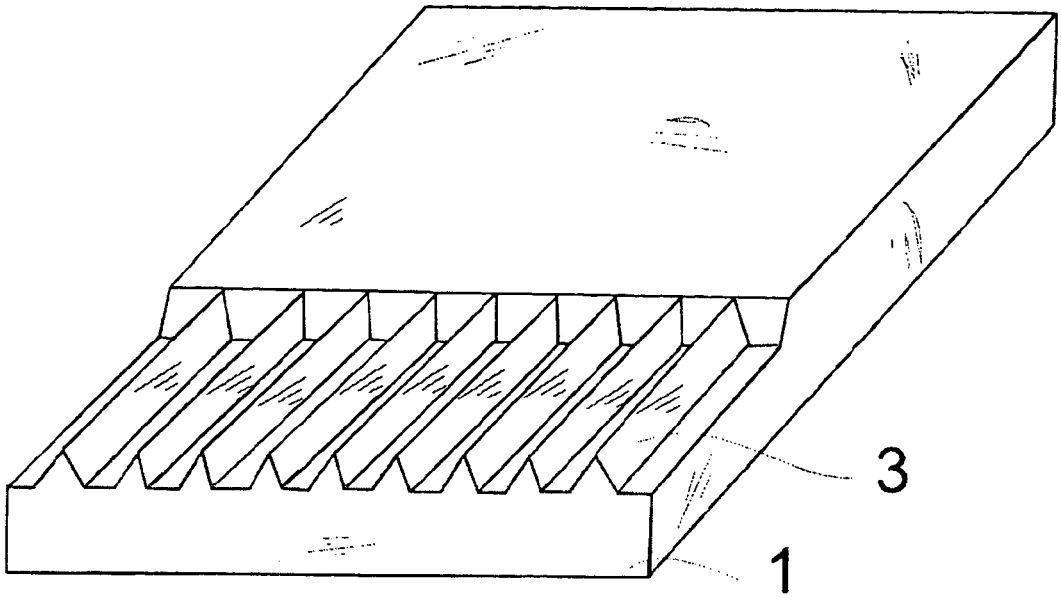
FIG. 3 is a perspective view of ridged lands on the first substrate.
Figure 4:
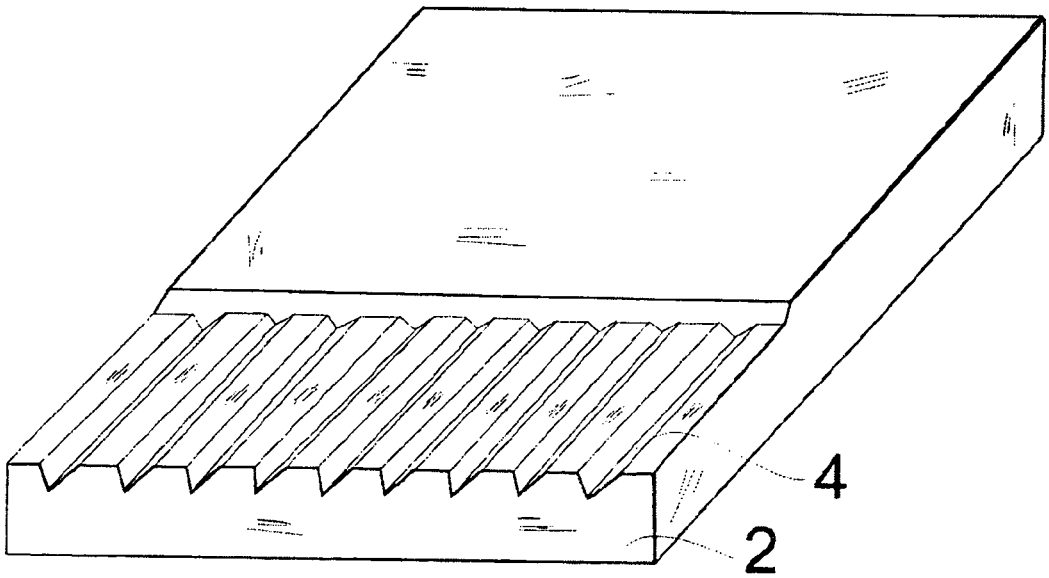
FIG. 4 is a perspective view of V-shaped grooves on the second substrate.

Referring to FIGS. 1 and 2, first, two elongated silicon substrates, a first substrate 1 and a second substrate 2 are selected. The first substrate 1 is lithographed and then etched into multiple triangle-shaped ridged lands 3 using dry plasma etching and/or anisotropic wet etching, as shown in FIG. 3. The area of etching is half of the substrate 1 and the contact area between the ridged lands 3 and no etched half is etched into a slope. The second substrate 2 is lithographed and then etched into multiple V-shaped grooves 4 in similar fashion, as shown in FIG. 4. The etched area is half of the substrate 2 and contact area between the grooves 4 and no etched half is etched into a slope.

Figure 5:
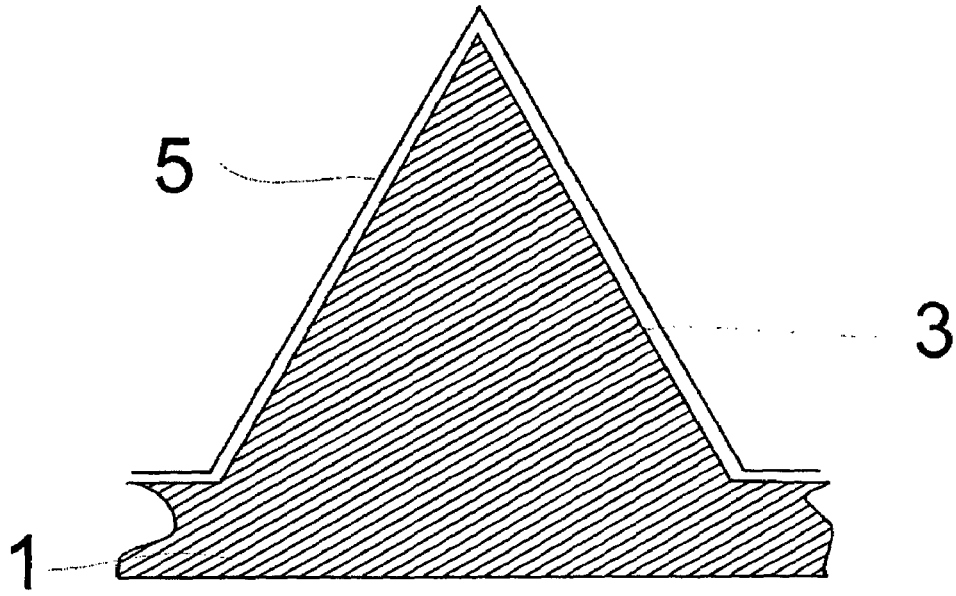
FIG. 5 is a silicon oxide layer formed on the ridged land.
Figure 6:
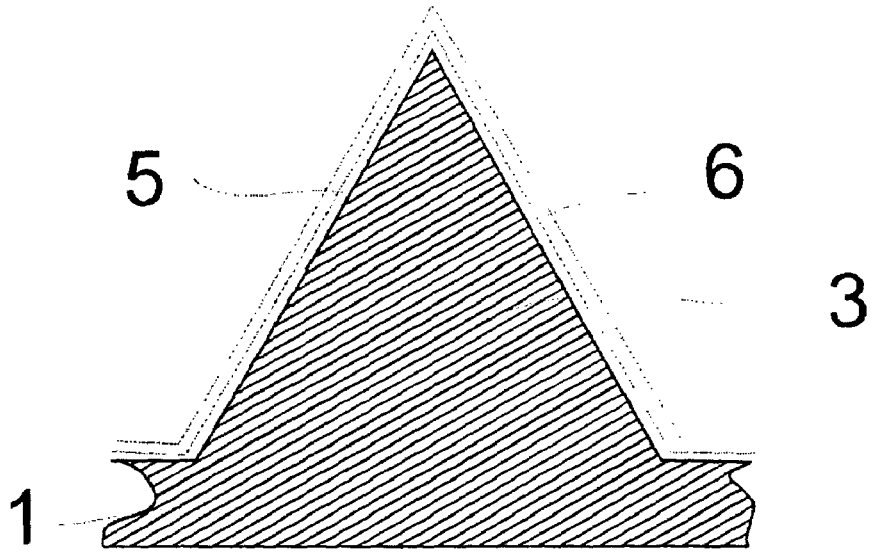
FIG. 6 is a conductive metal layer formed on the ridged land.
Figure 7:
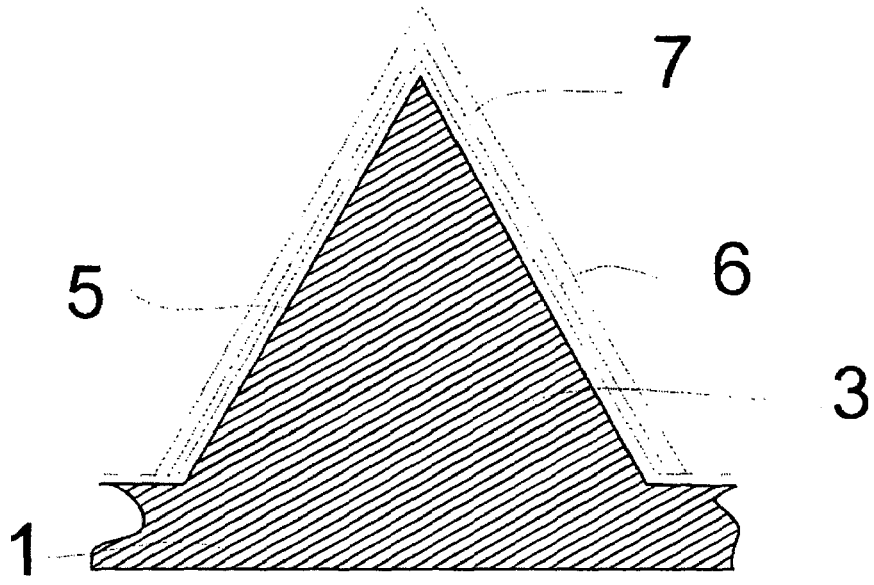
FIG. 7 is a catalyst film for a nano-meter line coated on the ridged land.
Figure 8:
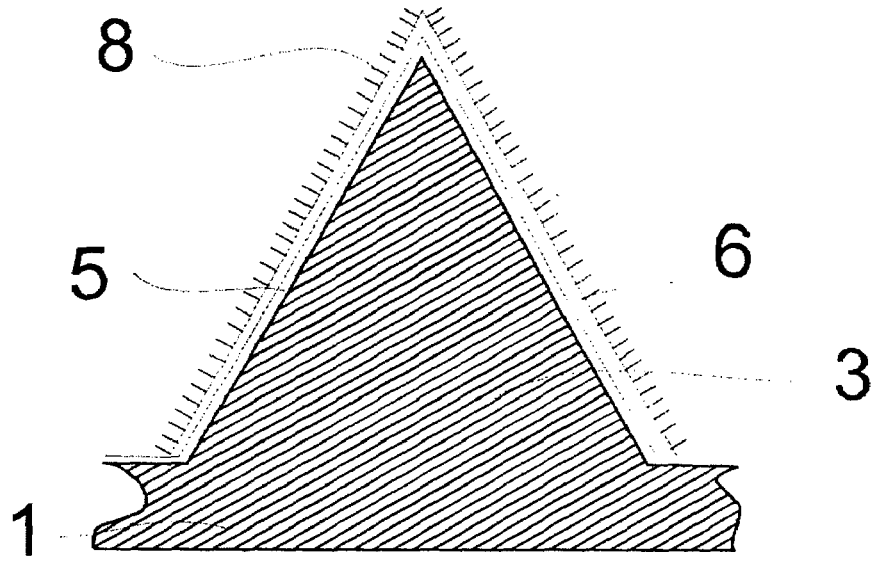
FIG. 8 is the nano-meter line grown on the ridged land.

Next, the first substrate 1 is heated in a reaction chamber while the oxygen is added; therefore, a layer of silicon oxide such as $SiO_2$ insulation 5 is formed on the first substrate 1, as shown in FIG. 5. Then a layer of conducting metal layer 6 is plated on the triangle-shaped ridged lands 3, as shown in FIG. 6, a thin film of nano-meter line catalyst 7 is coated onto the metal layer 6, as shown in FIG. 7, and nano-meter lines 8 are grown on the catalyst layer 7, as shown in FIG. 8. In same fashion, second substrate 2 is heated in a reaction chamber while oxygen is added in order to form a layer of $SiO_2$; then a conductive metal layer 6 is plated onto the V-shaped grooves 4.

Figure 9:
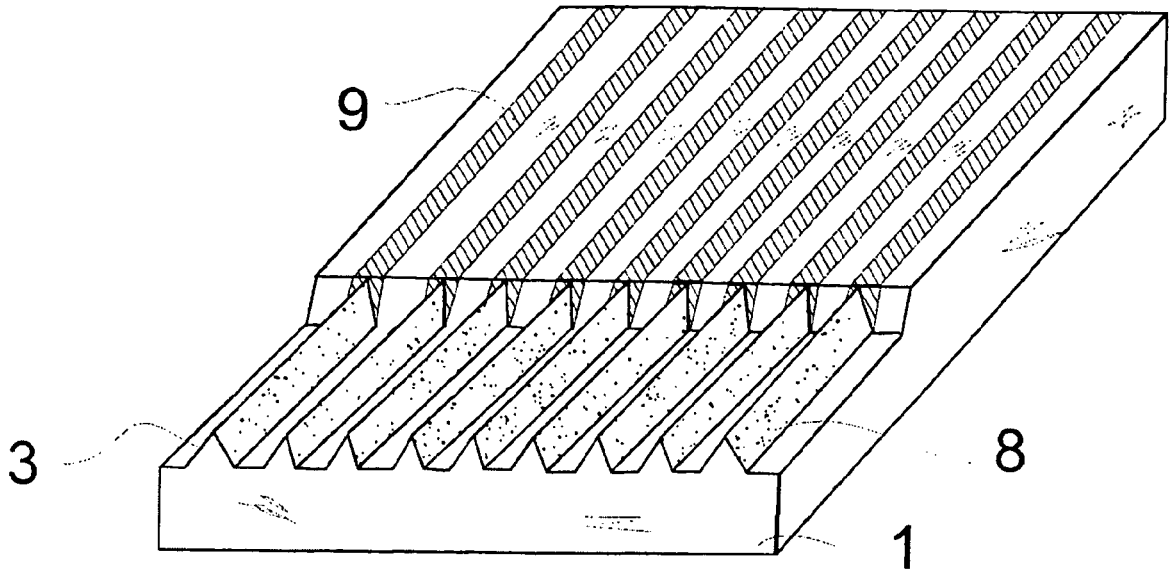
FIG. 9 is a perspective view of conductive metal bands plated on first substrate.
Figure 10:
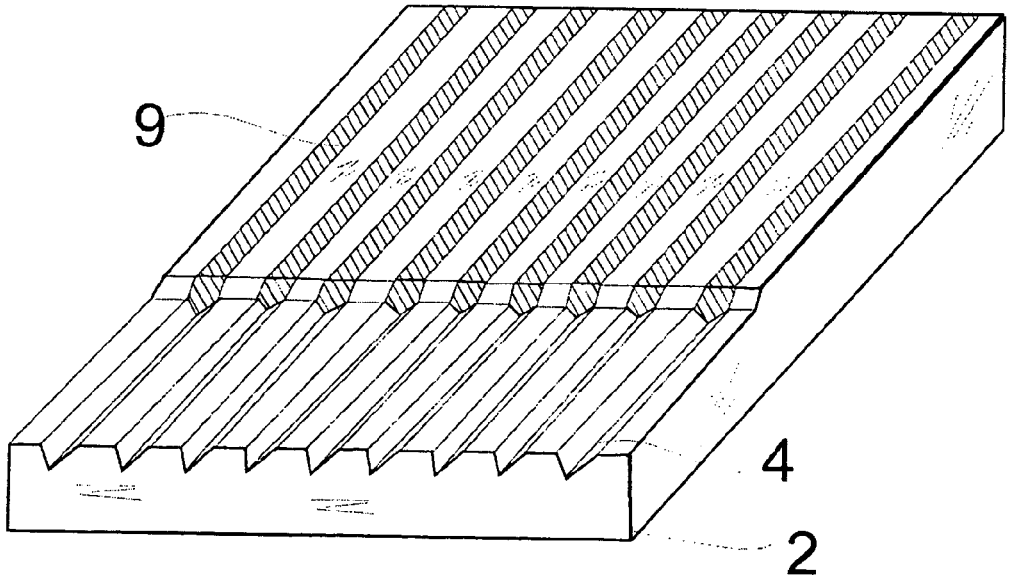
FIG. 10 is a perspective view of conductive metal bands plated on the second substrate.
Figure 11:
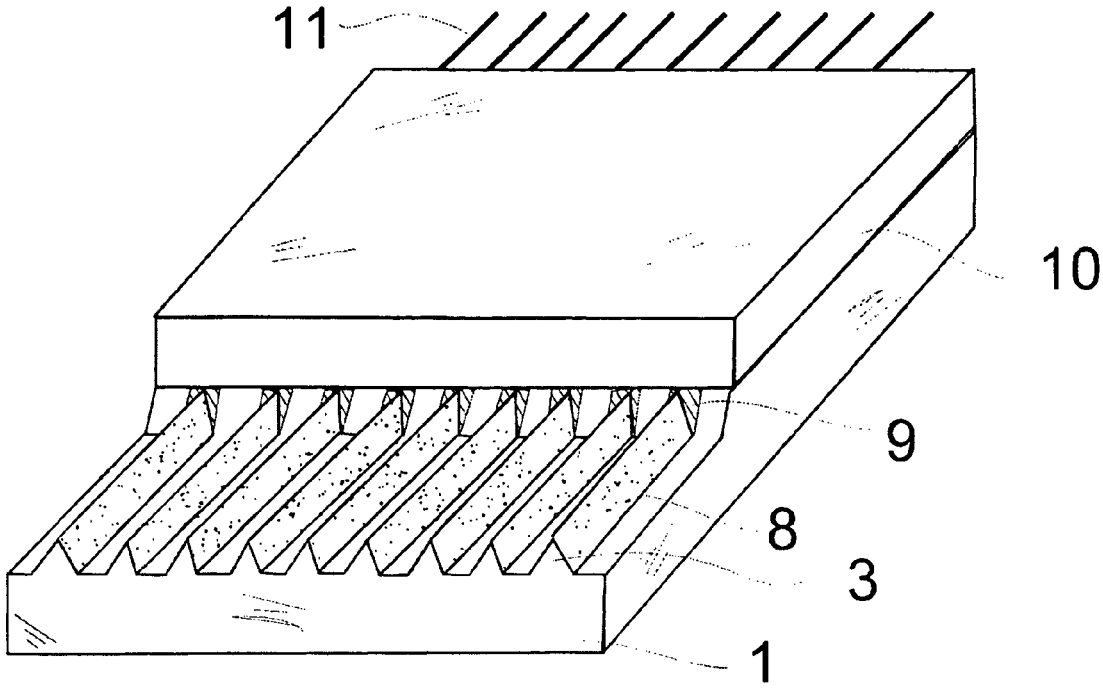
FIG. 11 is a perspective view of the first substrate connected with a ribbon wire.
Figure 12:
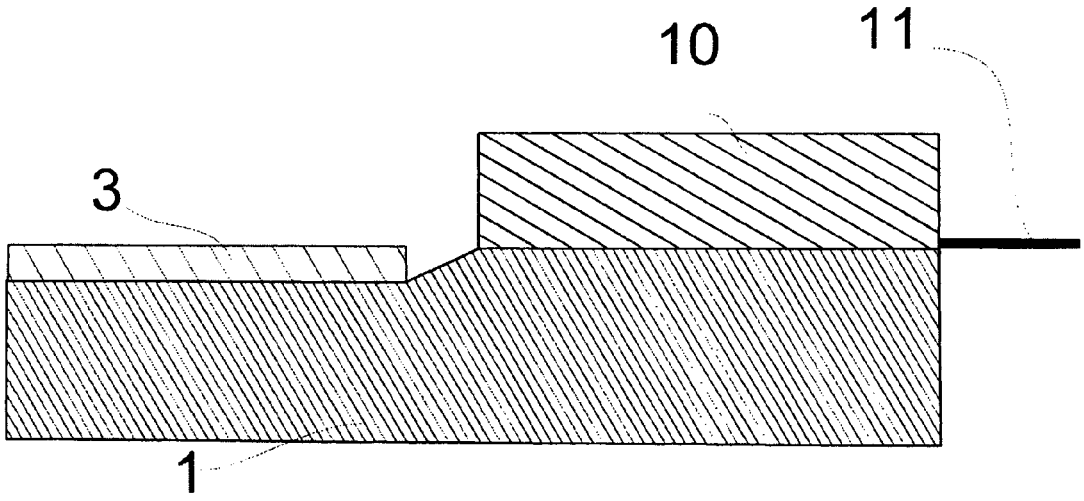
FIG. 12 is a cross sectional view of the first substrate connected with the ribbon wire.
Figure 13:
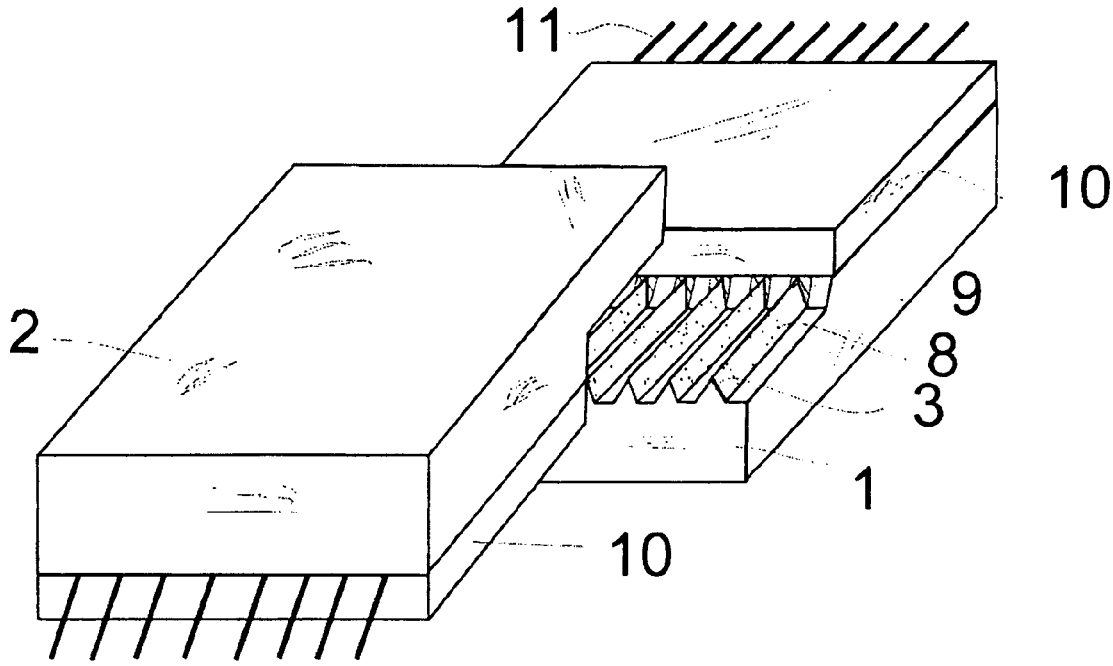
FIG. 13 is the first substrate connected to the second substrate in progress.
Figure 14:
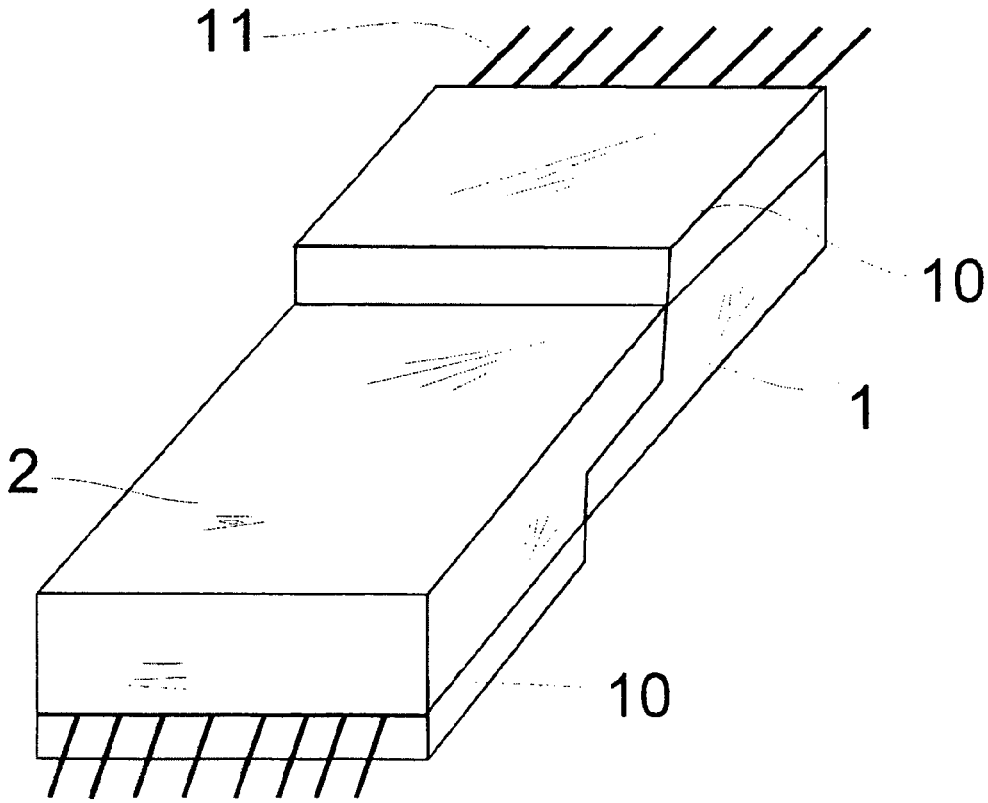
FIG. 14 is the first substrate completely connected to the second substrate.

Multiple conductive metal bands 9 are plated on non-etched areas at the second substrates 2 and on first substrate 1 with the nano-meter lines 8. These bands 9 extend to the etched slopes and connect to the triangle-shaped ridged lands 3 and the V-shaped grooves 4, as shown in FIGS. 9 and 10. A plurality of ribbon wires 11 are secured onto both substrates 1 and 2 by a fixing layer 10 thereof. The space between wires in the ribbon wires 11 is the same as space between conductive metal bands 9, and the ribbon wires 11 and the conductive metal bands 9 are connected to each other, resepctively, as shown FIGS. 11 and 12. Last, by combining the triangle-shaped ridged lands 3 to the V-shape grooves 4 the connection is completed, as shown in FIG. 13.

The present invention is first one proposing a method of making a nano-meter structure layer (i.e. nano-meter line). Major nano-meter material can be one of GaAs, Si, ZnO, GaN and ZnSe etc. There are several methods of growing the nano-meter line available. For example, for ZnO nano-meter line, a thin layer of catalyst, such as gold, is coated (thickness is about 50~500A, depending on desired thickness of the line), then heated (about 650° C.) to induce the thin film of catalyst into many nano-meter points, but the catalyst film does not react with substrate material. The catalyst is heated in furnace with gas added in, through process of VLS (Vapor-Liquid-Solid), the vapor of nano-meter compound is dissolved into the liquid state of metal catalyst film so that the nano-meter lines are formed. The diameter of the nano-meter line is about 10~100 nanometers and the length can reach several millimeters. The length is controlled by growth environment to desired length.

The slope (54.74°) of the triangle-shaped ridged lands 3 and the V-shaped grooves 4 is formed by using anisotropic etching. The grooves on second substrate 2 can be V-shaped or U-shape while the ridged lands on first substrate 1 can be triangle shaped or trapezoid shaped.

In summary, the present invention makes breakthrough both in terms of size and density of traditional connector by utilizing semiconductor and nano-meter technology. It becomes possible to fit 300 channels on a 1-centimeter wide substrate; moreover, stability of signal transmission is much improved due to the layer of the nano-meter structure.

While an illustrative and presently preferred embodiment of the invention has been described in detail herein, it is to be understood that the inventive conce-pts may be otherwise variously embodied and employed and that the appended cla-ims are intended to be construed to include such variations except insofar as limited by the prior art.

What is claim is:

1. A structure of a micro-connector comprising:

a first substrate comprising a plurality of ridged lands either in triangle or in trapezoid shape with a first insulation layer, a first conductive layer, a first nano-meter structure layer and a second nano-meter structure layer formed thereon, a plurality of first conductive metal bands, a first fixing layer and a plurality of first ribbon wires, wherein said first conductive metal bands respectively connect said first ribbon wires to said ridged lands, and said first fixing layer is used to secure said first ribbon wires onto said first substrate; and a second substrate comprising a plurality of grooves either in V-shape or U-shape with a second insulation layer, a second conductive layer formed thereon, a plurality of second conductive metal bands, a second fixing layer and a plurality of second ribbon wires, wherein said second conductive metal bands respectively connect said second ribbon wires to said grooves, and said second fixing layer is used to secure said second ribbon wires onto said first substrate, and wherein said grooves respectively match said ridged lands when the first and the second substrate are combined.

2. The structure of claim 1, wherein said first substrate and said second substrate is made of semiconductor or metal material.

3. The structure of claim 1, wherein said first nano-meter structure layer is grown on top of said first conductive layer.

4. The structure of claim 1, wherein said first or said second nano-meter structure layer is a nano-meter line, a nano-meter bar, a nano-meter ball or a nano-meter carbon pipe.

5. The structure of claim 1, wherein said first or said second insulation layer is a silicon oxide layer or a silicon nitride layer.

6. The structure of claim 1, wherein said first or said second conductive layer is a Cu, Ni, Au or Ag metal layer.

* * * * *